US005555595A

United States Patent [19]

Ligman

[11] Patent Number: 5,555,595

[45] Date of Patent: Sep. 17, 1996

[54] CARPET CLEANER UNIT WITH ADJUSTABLE POWER CONTROL

[75] Inventor: James R. Ligman, Santa Barbara, Calif.

[73] Assignee: Better Cleaning System, Inc., Madera, Calif.

[21] Appl. No.: 452,126

[22] Filed: May 26, 1995

[51] Int. Cl.[6] ..... A47L 7/00

[52] U.S. Cl. ..... 15/319; 15/321; 15/339; 15/412

[58] Field of Search ..... 15/319, 321, 339, 15/412

[56] References Cited

U.S. PATENT DOCUMENTS

| | | | |
|---|---|---|---|
| 3,262,146 | 7/1966 | Hays | 15/321 |
| 3,663,984 | 5/1972 | Anthony et al. | 15/321 |
| 3,774,261 | 11/1972 | Colt | 15/321 |
| 4,046,989 | 9/1977 | Parise et al. | 15/321 X |
| 4,153,968 | 5/1979 | Perkins | 15/321 |
| 4,307,484 | 12/1981 | Williams | 15/321 |

*Primary Examiner*—Chris K. Moore
*Attorney, Agent, or Firm*—Kelly Bauersfeld & Lowry

[57] ABSTRACT

A cleaner unit for carpet and upholstery and the like includes an adjustable power control so that electrical power usage can be set in accordance with available circuit capacity. The cleaner unit includes multiple electrical loads such as a vacuum motor, a pump for delivering a cleaning fluid to a cleaning head or tool, and one or more resistance heaters for heating the cleaning fluid, wherein these loads are adapted for plug-in connection by one or more power cords to a standard domestic power circuit. An ammeter permits the current load to be monitored. In the preferred form, the adjustable power control is associated with one of the resistance heaters and permits the heater current load to be variably set according to the available current capacity of the power circuit.

12 Claims, 3 Drawing Sheets

CARPET CLEANER UNIT WITH ADJUSTABLE POWER CONTROL

BACKGROUND OF THE INVENTION

This invention relates generally to improvements in machines and systems for use in cleaning carpets and upholstery and the like. More specifically, this invention relates to an improved cleaner unit having an adjustable power control so that electrical power usage can be variably set in accordance with available circuit capacity.

Carpet and upholstery cleaning systems and related equipment are, in general, relatively well-known in the art. Such systems commonly include a solution tank for receiving a supply of a selected cleaning fluid, in combination with a pump and related flow lines for delivering the cleaning fluid to an appropriate cleaning tool or head. The cleaning tool is normally designed for manual manipulation over a selected region of carpet or upholstery to be cleaned. In this regard, the cleaning action is typically enhanced by preheating the cleaning fluid with one or more electrical resistance heating elements. In addition, power-driven brush or vibratory elements can be provided on the cleaning tool to enhance the cleaning action. At the conclusion of a cleaning procedure, a vacuum motor is typically employed to vacuum excess fluid and entrained debris from the carpet or upholstery. All of these equipment components are frequently provided in a convenient portable form carried on a cart for easy transport directly to a site of use.

A typical cleaner unit for carpet and upholstery, as described generally above, thus includes multiple electrical loads which must be connected to an electrical power supply at the site of use. In a typical residential environment, the current capacity of a standard domestic household power circuit can vary within a significant range, typically on the order of 10 to 30 amps, depending upon the size rating of the fuse or circuit breaker associated therewith and other household loads which may be in operation when the cleaning unit is used. In this regard, modern carpet and upholstery cleaning units are commonly designed for optimum operational speed and efficiency, particularly by providing one or more resistance heaters so that a cleaning fluid can be heated rapidly and maintained at a desired elevated temperature for improved cleaning. In many cases, however, the total power requirements of the cleaner unit can exceed the available current capacity of a typical household power circuit, resulting in frequent tripping of circuit breakers and/or blowing of fuses, with corresponding delays in completion of the cleaning task. Such delays are, of course, particularly undesirable to professional cleaning services that schedule several cleaning procedures at different locations throughout the course of a typical work day.

In the past, to avoid undesirable tripping of circuit breakers and/or blowing of fuses, many portable cleaner units have been designed for reduced power usage typically by providing smaller resistance heaters which take longer to heat the cleaning fluid. Other cleaner unit designs have used multiple resistance heaters adapted for separate on-off operation, so that additional heaters can be turned on when the available circuit capacity is present.

The present invention provides further improvements in carpet and upholstery cleaner units, wherein one or more adjustable power controls can be variably set in association with one or more unit loads, so that the cleaner unit can be operated at maximum power level consistent with household circuit capacity.

SUMMARY OF THE INVENTION

In accordance with the invention, an improved cleaner unit is provided for use in cleaning carpet and upholstery and the like, wherein the cleaner unit includes an adjustable power control to enable unit operation at a substantially maximum power level consistent with available circuit capacity.

In the preferred form, the cleaner unit includes multiple electrical loads, such as one or more resistance heaters for heating a cleaning fluid within a solution tank, a pump for delivering the heated cleaning fluid to a cleaner tool or head, and a vacuum motor for drawing excess fluid and entrained debris from the cleaning site. These electrical loads are adapted for plug-in connection to an available domestic household power circuit by means of one or more power cords. In this regard, in the preferred embodiment, the electrical loads are wired in two groups for separate connection to the household power supply by means of a pair of power cords, thereby permitting the cleaner unit to be plugged into a pair of separately breakered power circuits.

An ammeter is provided for visually displaying current draw of the electrical loads. When the cleaner unit has multiple power cords, the ammeter is adapted for monitoring and displaying the current load associated with each power cord.

One or more adjustable power controls such as a phase angle controller is provided for variably setting the current load of the cleaner unit in accordance with available current capacity of the household power circuit. The adjustable power control is preferably associated with one of the resistance heaters for variably setting current draw during heater operation, so that total current load does not exceed available circuit capacity. When multiple resistance heaters are used in association with different power cords, multiple adjustable power controls can be individually associated with the resistance heaters so that the current load associated with each power cord can be variably set. A temperature sensor monitors the temperature of the heated cleaning fluid and is coupled to each power control in the system for on-off cycling of the heaters associated therewith to maintain the cleaning fluid temperature level within a desired range.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
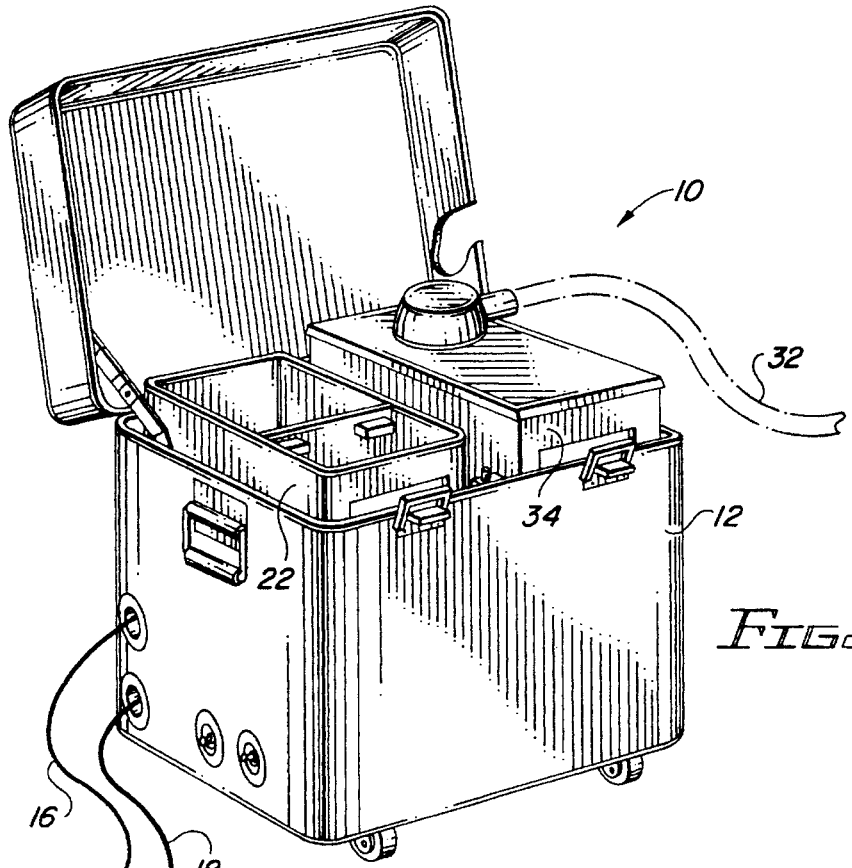
FIGS. 1 and 2 are perspective views representing a cleaner unit of a type embodying the novel features of the invention.
Figure 2:
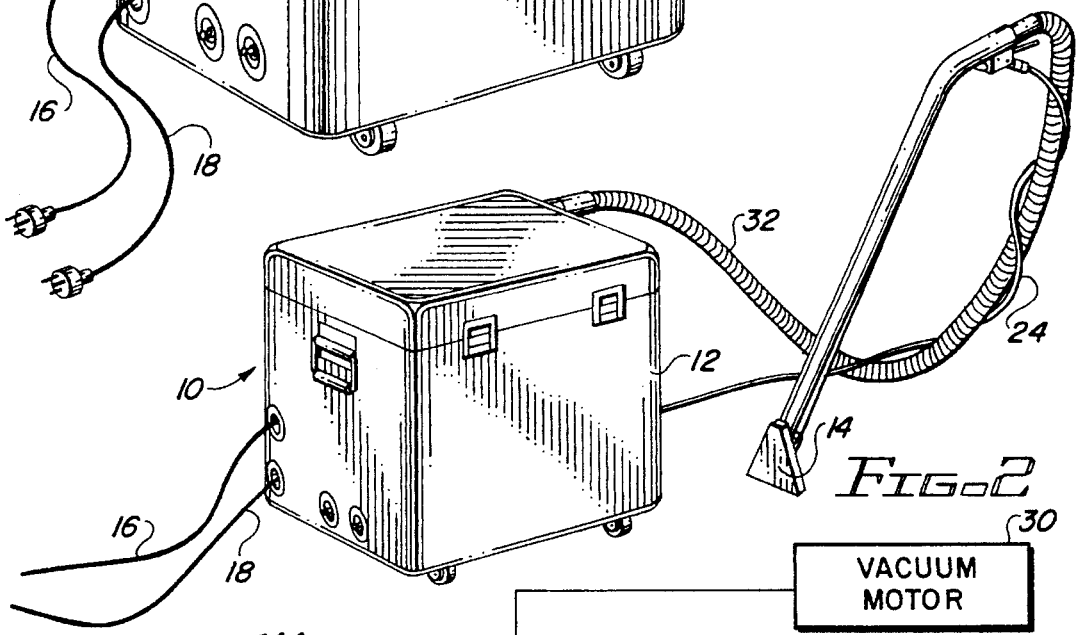

As shown in the exemplary drawings, a cleaner unit referred to generally in FIGS. 1 and 2 by the reference numeral 10 is provided for use in cleaning upholstery materials such as carpets, draperies, furniture coverings, etc. The cleaner unit 10 comprises a relatively compact and transportable wheeled cart 12 and associated cleaning tool or head 14 (FIG. 2) for manipulation over carpet surfaces and the like to dislodge and vacuum away dirt and other debris. In accordance with the invention, the cleaner unit 10 includes means for variably setting the total electrical power usage in accordance with available power circuit capacity, so that a cleaning task can be performed quickly and with maximum efficiency.

The cleaner unit 10 has an overall construction and operation generally known in the art, as illustrated by way of example in U.S. Pat. 4,974,282, which is incorporated by reference herein. More particularly, with reference to FIGS. 1–3 the cleaner unit comprises a plurality of components including various electrical loads mounted on the portable cart 12, and adapted for plug-in connection to an available domestic household power circuit or circuits by means of one or more power cords 16, 18, two of which are illustrated in the accompanying drawings. These electrical loads commonly include a circulation pump 20 for circulating a selected cleaning fluid from a solution tank 22 through flow lines 24 to the cleaning tool 14, whereat the cleaning solution is applied to a carpet or upholstery surface. To enhance cleaning efficiency, the cleaning solution within the tank 22 is normally heated by one or more electrical resistance heaters 26, 28, two of which are shown in FIG. 2. A vacuum motor 30 is provided to draw expended cleaning solution and entrained debris through a vacuum hose 32 to a recovery tank 34 on the cart 12. Additional electrical loads may be provided such as vibratory or rotary brush and/or heater elements (not shown) mounted within the cleaning tool 14.

Figure 3:
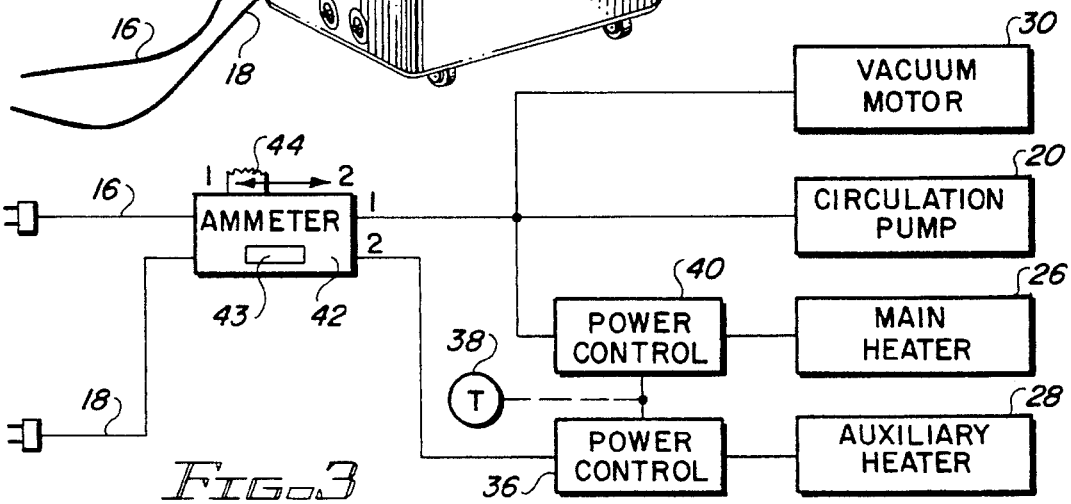
FIG. 3 is a schematic diagram illustrating multiple electrical loads of the cleaner unit for plug-in connection to a household power supply.

As shown in FIG. 3, the multiple electrical loads of the cleaner unit 10 may be separately wired in association with the dual power cords 16, 18, so that these loads can be plugged into two different and independently breakered household power circuits. For example, the vacuum motor 30 is shown connected in combination with the circulation pump 20 and a main heater 26 for connection to a power supply by means of the power cord 16. The second heater 28 comprises an auxiliary resistance heater and is adapted for plug-in connection to the power supply by means of the second power cord 18. With this arrangement, the combined electrical loads of the cleaner unit 10 can be operated at a higher total power usage, representing a summation of the current capacities of two different household power circuits, resulting in faster heating of the cleaning solution to a higher temperature, with a corresponding improved speed and efficiency of the cleaning task.

In accordance with a primary aspect of the present invention, an adjustable power control 36 is provided in association with the auxiliary heater 28, so that the current draw during heater operation can be adjustably set in accordance with available circuit capacity. That is, by way of example, the power control 36 can be adjusted for heater operation at about 15 amps, when the associated power cord 18 is plugged into a household circuit having a current capacity of about 15 amps. However, when the household circuit has a higher current capacity, such a 20 amps, the power control 36 can be adjusted to increase the current draw of the auxiliary heater 28 and thereby increase the heating rate for the cleaning solution. In this regard, during normal operation of the cleaner unit 10, the auxiliary heater 28 is normally cycled on and off to maintain the cleaning fluid within a prescribed high temperature range, by means of a temperature sensor 38 which may be coupled to the power control 36 in a manner to be described in more detail.

Similarly, in a preferred form of the invention, a second adjustable power control 40 may be employed in association with the main heater 26 for variably setting the current draw during operation of the cleaner unit. Once again, the current draw of the heater 26 is adjusted so that the total current load represented by the components associated with the power cord 16 will not exceed the current capacity of the household power circuit into which the cord 16 is plugged. The temperature sensor 38 may also be used in association with the main heater 26 and its power control 40 to obtain on-off cyclic operation of the heater.

When the dual power cords 16, 18 are used to connect the electrical loads of the cleaner unit 10 to household power circuits, a single ammeter 42 is conveniently employed for monitoring and indicating actual current draw on each circuit. The ammeter 42 may conveniently include a digital readout 43, such as an ammeter of the type marketed by Modutec/Emico of Manchester, N.H., under model designation BL-533439-04, having a switch 44 for coupling the ammeter 42 with the power cord 16, 18, one at a time, to obtain a readout of actual current draw.

Figure 4:
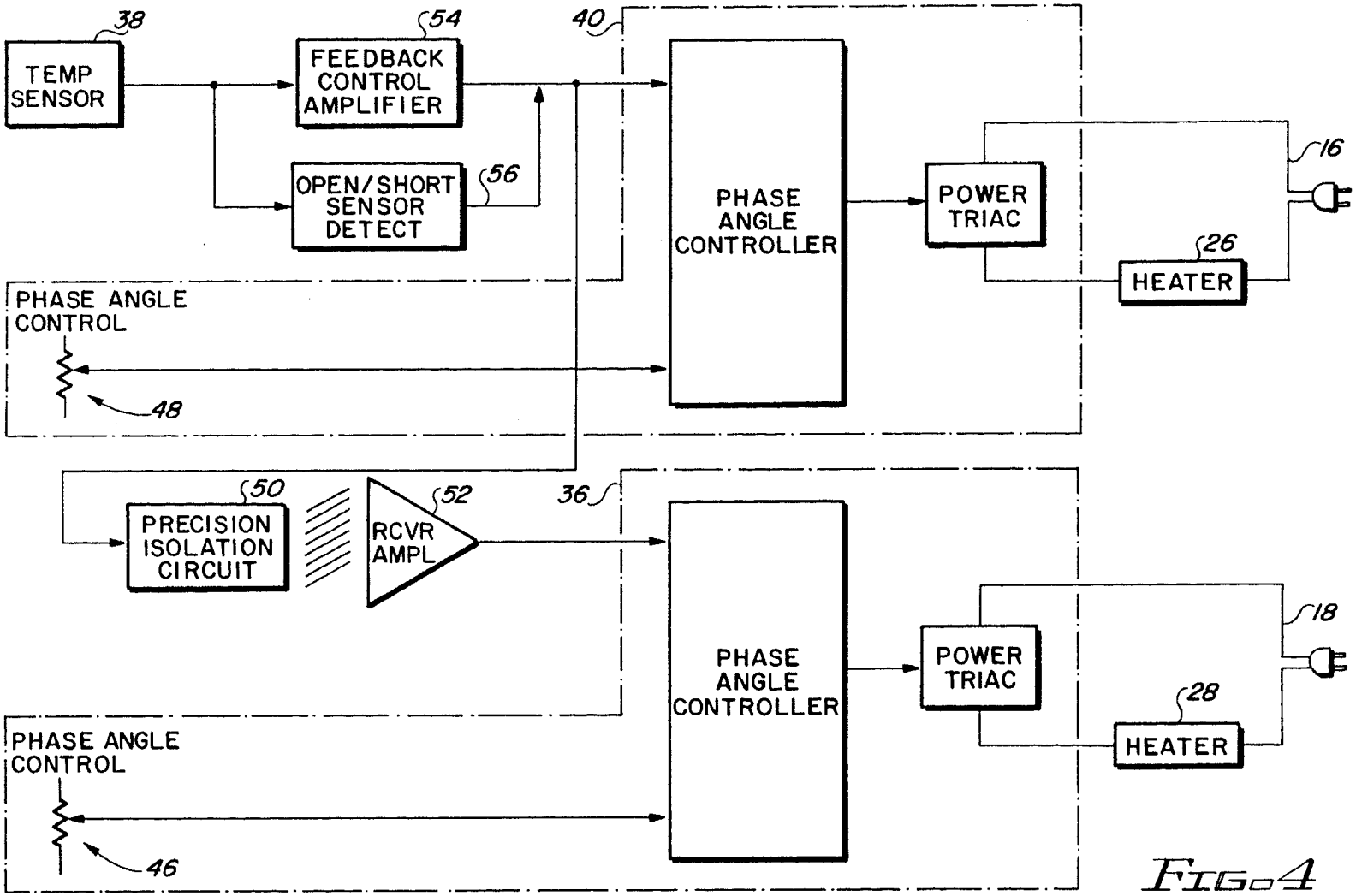
FIG. 4 is a schematic block diagram depicting adjustable power controls in accordance with one preferred form of the invention.

FIG. 4 is a schematic diagram illustrating the adjustable power controls 36 and 40 in association with the main and auxiliary heaters 26, 28, respectively. As shown, the power controls 36, 40 may comprise phase angle controllers each associated with an adjustable power control knob 46, 48 to obtain the desired current draw maximum setting according to power circuit capacity. These controls 36, 40 are coupled together by means of a precision isolation circuit 50 and associated receiver/amplifier 52 to enable on-off cycling of the phase angle controllers by means of the common temperature sensor 38. The temperature sensor 38 monitors the temperature of the cleaning solution, and provides an appropriate temperature signal to both of the phase angle controllers. A feedback control amplifier 54 and associated feedback loop 56 prevent system operation in the event of temperature sensor failure.

Figure 5:
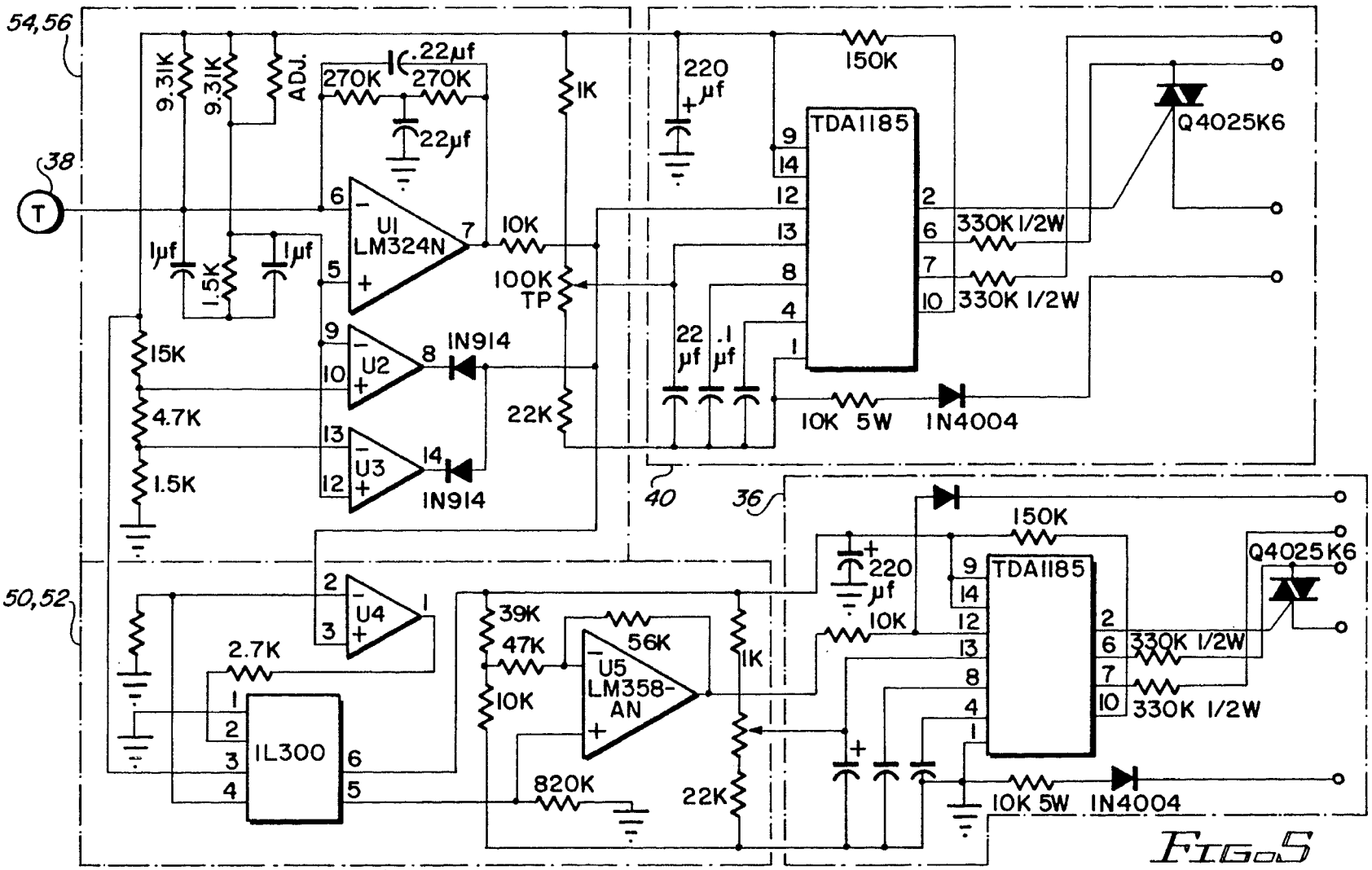
FIG. 5 is a circuit diagram implementation of the embodiment shown in FIG. 4.

The various circuit components for implementing the schematic diagram of FIG. 4, are shown in more detail in one preferred embodiment in FIG. 5, wherein block components of FIG. 4 are represented diagrammatically by dotted line enclosures.

The improved cleaner unit 10 of the present invention thus may be adjustably set quickly and easily for actual power usage consistent with available power circuit capacity. The cleaner unit can be operated with maximum efficiency at each job site, according to actual power circuit capacity, and without annoying delays attributable to repeated tripping of circuit breakers.

A variety of further modification and improvements to the invention described herein will be apparent to those skill art. For example, while phase angle controllers are shown and described for adjustable power control, it will be understood that other controller types may be used such as a zero crossing detector and the like. Accordingly, no limitation on the invention is intended by way of the foregoing description and accompanying drawings, except as set forth in the appended claims.

What is claimed is:

1. A cleaner unit for use in cleaning carpet and upholstery and the like, said cleaner unit comprising:

a plurality of electrical loads including at least one heater for heating a cleaning fluid, a pump for circulating the cleaning fluid to a cleaning tool, and a vacuum motor for vacuuming the cleaning fluid and debris from a surface being cleaned;

power cord means for connecting said loads to a power circuit;

means for monitoring and indicating electrical current usage by said cleaner unit during operation; and an adjustable power control for variably setting current draw of at least one of said loads so that the electrical current usage of said cleaner unit does not exceed the current capacity of the power circuit.

2. The cleaner unit of claim 1 wherein said adjustable power control variably sets the current draw of said at least one heater.

3. The cleaner unit of claim 2 further including temperature sensor means responsive to the temperature of the cleaning fluid to turn said at least one heater on and off in a cyclic manner to maintain the temperature of the cleaning fluid within a prescribed range.

4. The cleaner unit of claim 1 wherein said adjustable power control is a phase angle controller.

5. The cleaner unit of claim 1 wherein said at least one heater comprises a main heater and an auxiliary heater, said adjustable power control being for variably setting the current draw of one of said main and auxiliary heaters.

6. The cleaner unit of claim 5 wherein said power cord means comprises a pair of power cords for separate plug-in connection of said main and auxiliary heaters to said power circuit.

7. The cleaner unit of claim 6 wherein said pump and vacuum motor are electrically connected with said main heater to the same one of said power cords.

8. The cleaner unit of claim 1 wherein said at least one heater comprises a main heater and an auxiliary heater, and further wherein said power cord means comprises a pair of power cords for separate plug-in connection of said main and auxiliary heaters to said power circuit, said adjustable power control comprising a pair of adjustable controllers for separately and variably setting the current draw of each of said main and auxiliary heaters.

9. The cleaner unit of claim 8 wherein said means for monitoring and indicating electrical current usage comprises an ammeter coupled to both of said power cords and including switch means for separately monitoring and indicating the current draw on said power cords.

10. The cleaner unit of claim 8 further including temperature sensor means responsive to the temperature of the cleaning fluid to turn said main and auxiliary heaters on and off in a cyclic manner to maintain the temperature of the cleaning fluid within a prescribed range.

11. The cleaner unit of claim 10 wherein said temperature sensor means comprises a single temperature sensor coupled to said pair of adjustable controllers, and further including isolation circuit means for electrically isolating said controllers from each other.

12. The cleaner unit of claim 8 wherein said pump and vacuum motor are electrically connected with said main heater to the same one of said power cords.

* * * * *